US005706544A

United States Patent [19]

Young

[11] Patent Number: 5,706,544

[45] Date of Patent: Jan. 13, 1998

[54] MOPHEADS

[75] Inventor: Ronald Alexander Young, Ontario, Canada

[73] Assignee: Scot Young Research, Inc., St. Joseph, Mo.

[21] Appl. No.: 604,235

[22] Filed: Feb. 21, 1996

[30] Foreign Application Priority Data

Feb. 22, 1995 [GB] United Kingdom ..... 9503476

[51] Int. Cl.[6] ..... A47L 13/12; A47L 13/20

[52] U.S. Cl. ..... 15/115; 115/119; 115/229.2

[58] Field of Search ..... 15/115, 118, 228, 15/229.1–229.9

[56] References Cited

U.S. PATENT DOCUMENTS

| | | | |
|---|---|---|---|
| 1,526,528 | 2/1925 | Christy . | |
| 1,739,704 | 12/1929 | Yancey . | |
| 1,781,237 | 11/1930 | Merkle . | |
| 2,482,163 | 9/1949 | Finnell | 15/118 X |
| 2,825,914 | 3/1958 | Moss | 15/118 X |
| 2,887,712 | 5/1959 | Vosbikian et al. | 15/118 X |
| 3,324,497 | 6/1967 | Moss . | |
| 3,336,620 | 8/1967 | Moss . | |
| 3,432,873 | 3/1969 | Moss . | |
| 3,501,796 | 3/1970 | Moss | 15/118 |
| 3,795,934 | 3/1974 | Moss . | |
| 3,817,004 | 6/1974 | Moss . | |
| 4,679,859 | 7/1987 | Wilson | 300/21 |

FOREIGN PATENT DOCUMENTS

| | | |
|---|---|---|
| 503667 | 6/1920 | France . |
| 27 40 417 | 3/1978 | Germany . |
| 38 02 198 | 6/1989 | Germany . |
| 960563 | 6/1964 | United Kingdom . |

*Primary Examiner*—Mark Spisch
*Attorney, Agent, or Firm*—Wm. Bruce Day

[57] ABSTRACT

A mophead comprises a bundle of flexible strands which are gathered and held together at the center and which are connected together at positions spaced from but adjacent to each of their two ends. Each edge portion of each mop half is connected to an adjacent edge portion of the other mop half, such as by tapes and the length of the strands and the width of the strands where gathered together at the center is such that a user may selectively use the entire undersurface of the mophead or the upper surfaces of the two mop halves for mopping. The width of the strands where gathered together at the center is at least 10 cms, and the length of the strands from end to end is at least 50 cms.

11 Claims, 2 Drawing Sheets

MOPHEADS

This invention relates to mopheads, which are in use connected to a handle and which are used, for example, for wet mopping of floors.

Mopheads made for commercial use in hospitals, hotels, restaurants and the like generally fall into two categories.

The first category is known as "round mopheads". These comprise a bundle of flexible strands (sometimes referred to as "threads") which are gathered together at the centre (to define two fan shaped parts) where they are secured to a holder or where they are held together by a band (commonly referred to as "a centre band") for subsequent insertion into a holder and which are connected together at positions spaced from but adjacent to opposite ends so that they define a generally circular mophead the undersurface of which is used for mopping. The holder is attached, or is attachable, to a handle. The bundle of strands is often made by producing a multiplicity of loops in a single length of flexible material, such as cotton or Syntex (a material made by Filature Lemiéux of Canada). The strands typically have a length of no more than about 35 cm from end to end. The holder is usually circular and the width of the bundle where gathered in the centre is 7.5 cm or much less. The strands are often connected together adjacent to each of their opposite ends by a tape which is passed around the bundle of strands to define a band and which then has its upper and lower runs stitched together. The two bands are then tacked together at opposite end by stitching.

The second category is known as "stay flat mopheads". These also comprise a bundle of flexible strands which are gathered together at the centre where they are secured to a holder or held together by a band for subsequent insertion a holder and which are connected together at positions spaced from but adjacent to each of their two ends. In this case, the two halves of the mophead are only joined at the centre, i.e. by the holder or band. In this case, the one half of the mophead folds under the other half during mopping in one direction and vice versa when mopping in the other direction with the result that it is the upper surfaces of the two mop halves which are used. It is impossible to open up the two halves of a stay flat mophead by twirling the handle of the mop. The bundle of strands is again often made by producing a multiplicity of loops in a single length of flexible material. However, in this case, the strands have a much longer length than those of "round mophead" and the holder is elongate so that the bundle, where gathered together in the middle, has a width significantly greater than "round mopheads".

Thus the undersurface of "round mopheads" is used and the upper surface of "stay flat mopheads" is used for mopping.

SUMMARY OF THE INVENTION

According to the present invention there is provided a mophead comprising a bundle of flexible strands which are gathered and held together at the centre and which are connected together at positions spaced from but adjacent to each of their two ends, each edge portion of each mop half being connected to an adjacent edge portion of the other mop half and the length of the strands and the width of the strands where gathered together at the centre being such that a user may selectively use the entire undersurface of the mophead or the upper surfaces of the two mop halves for mopping.

Preferably, the width of the strands where gathered together at the centre is at least 10 cm, and more preferably at least 12 cm. Typically, this width is about 14 cm.

Preferably, the length of the strands from end to end is at least 50 cm, and more preferably at least 60 cm. Typically, this length is about 75 cm.

The bundle of strands may be formed by a multiplicity of loops of a single length of flexible elongate material.

The strands may be connected together adjacent to each end by a tape which passes around the strands to define a band and which has its upper and lower runs connected together, such as by stitching. In this case, each end of one band is connected to an adjacent end of the other band, such as by stitching.

Preferably, the strands are held together at the centre by a holder, typically a plastics holder, or by a band for subsequent insertion into a holder, the holder being attached, or attachable, to a handle.

Conveniently, an abrasive pad or brush is connected to the underside of the mophead.

The invention will now be more particularly described with reference to the accompanying drawings.

DESCRIPTION OF THE PREFERRED EMBODIMENTS

Figure 1:
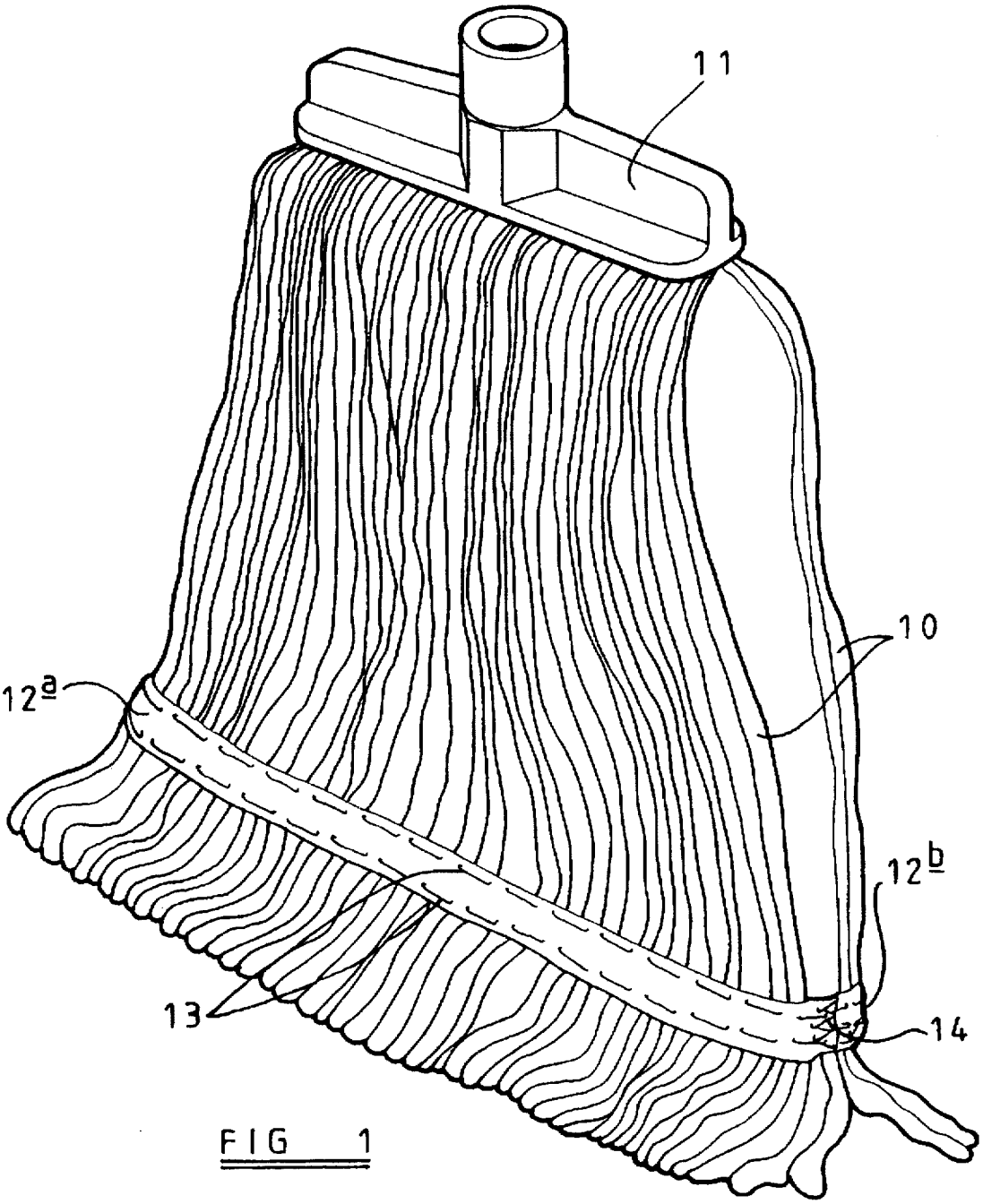
FIG. 1 is a perspective view of one embodiment of a mophead according to the invention, FIGS. 2(*a*)–2(*c*) show how the mophead of FIG. 1 can be opened up by twirling the handle of the mop.

Referring now to the drawings, the mophead shown therein comprises a bundle of strands 10 and an elongate plastics holder 11.

The strand bundle is made by forming a multiplicity of loops in a single length of elongate flexible material, typically cotton or Syntex. A rectangular blank is then formed by connecting the strands together at positions spaced from, but adjacent to, opposite ends of the strands. The strands are connected adjacent to each of their opposite ends by passing a tape 12*a*, 12*b* around the strands and connecting the upper and lower runs of each tape together by stitching 13.

The strands 10 are gathered together at the centre to define two fan shaped parts and secured at the centre to the holder 11 in known manner or held together by a band for subsequent insertion into a holder. Each end of the tape 12*a* is secured to an adjacent end of the tape 12*b* by stitching 14 so that the two tapes 12*a*, 12*b* together form an endless loop securing opposite ends of the strands 10 together.

The holder is attached to a handle (not shown).

The width of the strands 10 where gathered together at the centre is at least 10 cm. more preferably 12 cm and typically about 14 cm and the length of the strands from end to end is at least 50 cm, more preferably at least 60 cm and typically about 75 cm.

Figure 2A:
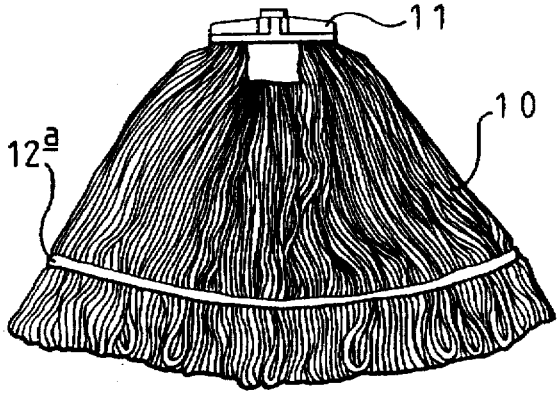
Figure 2B:
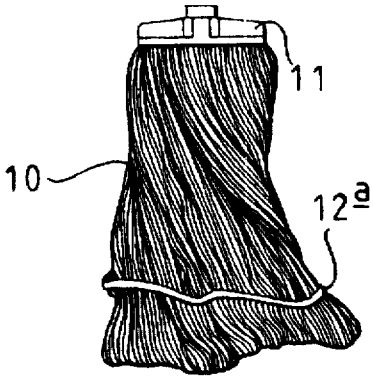
Figure 2C:
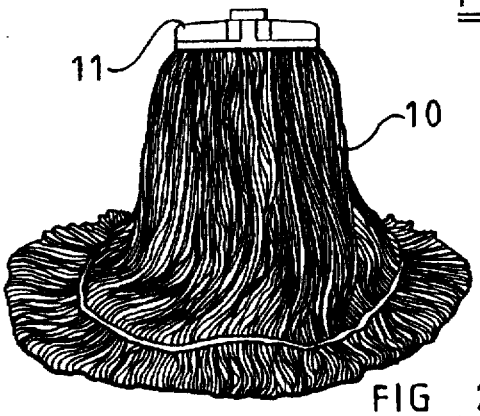
Figure 3:
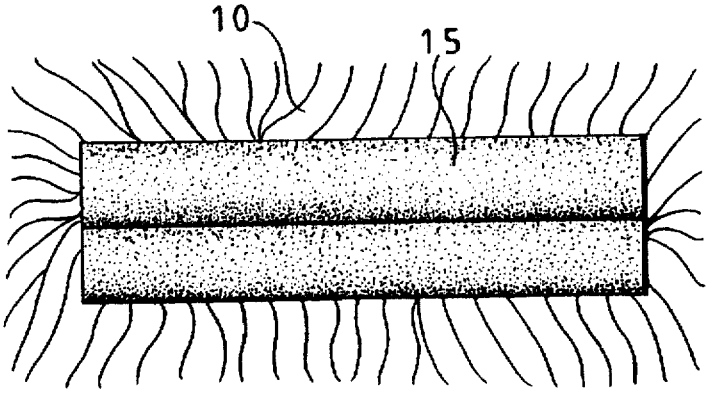
FIG. 3 is a fragmentary view showing part of the underside of the mophead.
Figure 4:
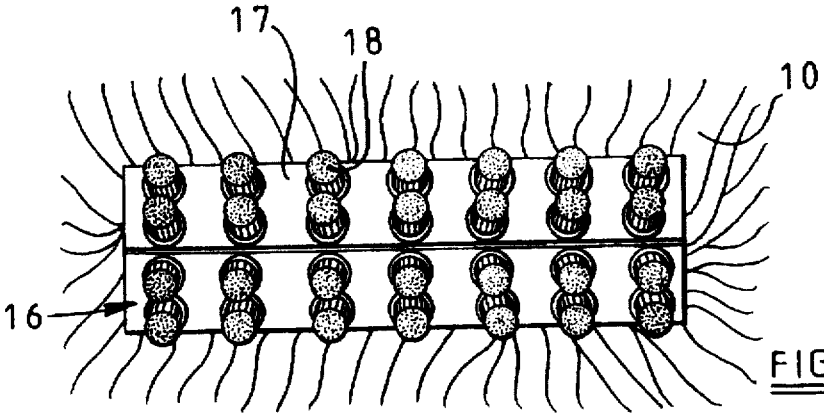
FIG. 4 is a view similar to FIG. 3 showing a modified mophead.

This will allow the mophead to be used as a conventional "stayflat mophead" in which one half of the mophead folds underneath the other half of the mophead as they are trailed behind the holder over a floor surface. It will also allow the mophead to be twirled open in a manner shown in FIGS. 2(*a*)–2(*c*) so that it can be used in similar manner to a conventional "round mophead"in which the entire underside of the mophead is used for mopping. It will also allow an abrasive pad 15 (FIG. 3) or a scrubbing brush 16 (FIG. 4) to be fixed to the underside of the mophead for removing stubborn dirt. The pad 15 or brush 16 is held in the holder 11 at the centre of the mophead. The brush 16 comprises a plastics base 17 and bristles 18. The base 17 is in four parts connected together by integral hinges. Two parts are trapped in the holder 11 and the other two parts carry the bristles 18. The pad or brush would serve no useful function on conventional stay flat mopheads because of the practical difficulty of parting the two halves of the mophead by a twirling action of the handle. The two halves simply remain in the condition shown in FIG. 2(*b*) and do not open out as shown in FIG. 2(*c*).

The above embodiment is given by way of example only and various modifications will be apparent to persons skilled in the art without departing from the scope of the invention. For example, the strands could be individual rather than being made by producing loops in a single length of flexible material. The holder need not be of plastics material and the tapes could be secured to the strands by means other than stitching.

What is claimed is:

1. A mophead comprising:

a substantially rectangular array of elongated flexible strands folded at a center portion thereof to define a pair of mop halves, said strands being held together at said center portion by a holder member, the strands of each mop half being connected together by a first stitching means extending therealong substantially the entire width of the respective mop half, the first stitching means of each mop half being adjacent to and spaced from the end of the respective mop half, opposite edge portions of each mop half being secured to opposite edge portions of the other mop half by second stitching means, wherein the portion of the mop halves intermediate the opposite edge portions are not secured to their opposed mop half whereby the two halves of the mophead may be parted by applying a twirling action to the holder member.

2. The mophead of claim 1, wherein said holder member has an underside with scrubbing means thereon.

3. A mophead comprising:

a generally rectangular bundle of flexible strands presenting opposed first and second ends, opposed side edges, and a center portion intermediate the ends;

a holding means for holding the strands of the bundle together at the center portion to divide the bundle into a pair of mop halves;

a first band for holding the strands of the bundle together near the first end of the bundle;

a second band for holding the strands of the bundle together near the second end of the bundle;

the first and second bands each presenting opposed ends disposed at the side edges of the bundle, the ends of the first band being connected to the ends of the second band to permit the two halves of the mophead to be parted by applying a twirling action to the holding means.

4. The mophead of claim 3, wherein the holding means is a holder member adapted to be connected to a handle.

5. The mophead of claim 3, wherein said center portion has a width of at least 10 cm.

6. The mophead of claim 3, wherein said center portion has a width of at least 12 cm.

7. The mophead of claim 3, wherein each of said mop halves has a length of at least 25 cm.

8. The mophead of claim 7, wherein each of said mop halves has a length of at least 30 cm.

9. The mophead of claim 3, wherein said first and second bands have a top and a bottom portion and wherein said top and bottom portions are secured to said strands by stitching said top and bottom portions to said strands.

10. The mophead of claim 3, wherein said center portion has an underside and wherein an abrasive pad is coupled to said underside of said center portion.

11. The mophead of claim 3, wherein said center portion has an underside and wherein a brush is coupled to said underside of said center portion.

* * * * *